United States Patent [19]

Pizzedaz

[11] 4,272,976

[45] Jun. 16, 1981

[54] HOT STRIP ROLLING MILL STAND

[75] Inventor: Ronald D. Pizzedaz, Springdale, Pa.

[73] Assignee: Mesta Machine Company, Pittsburgh, Pa.

[21] Appl. No.: 45,638

[22] Filed: Jun. 5, 1979

[51] Int. Cl.[3] ..... B21B 27/10

[52] U.S. Cl. ..... 72/45; 72/201; 72/236

[58] Field of Search ..... 72/41, 43, 44, 45, 201, 72/236

[56] References Cited

U.S. PATENT DOCUMENTS

| | | | |
|---|---|---|---|
| 1,634,258 | 7/1927 | Halpin | 72/44 |
| 1,994,691 | 3/1935 | Dahl et al. | 72/236 |
| 2,033,046 | 3/1936 | Montgomery | 72/201 |
| 2,056,433 | 10/1936 | Matthews | 72/201 |
| 2,107,541 | 2/1938 | Long | 72/201 X |
| 2,275,113 | 3/1942 | Simborg | 72/236 |
| 3,200,629 | 8/1965 | James et al. | 72/201 |
| 3,994,151 | 11/1976 | Stock et al. | 72/201 |

FOREIGN PATENT DOCUMENTS

| | | | |
|---|---|---|---|
| 52-17515 | 5/1977 | Japan | 72/45 |
| 431027 | 6/1935 | United Kingdom | 72/44 |

*Primary Examiner*—Ervin M. Combs
*Attorney, Agent, or Firm*—Howard E. Sandler

[57] ABSTRACT

A hot strip rolling mill stand, and more particularly a mill stand for use in the hot rolling process of a continuous strip casting system for aluminum, aluminum alloys and other metals, and which includes an improved means for the discrete applications of coolant for cooling rolls and to maintain thermostability and also for applying direct application lubricant for the strip being reduced.

15 Claims, 8 Drawing Figures

HOT STRIP ROLLING MILL STAND

Modern technology has resulted in the relatively recent commercial development of continuous strip casting systems wherein molten metal is continuously cast into a strip and thereafter continuously passed to a one or two-stand hot strip rolling mill for reduction. Reduced strip from such a continuous casting strip system would then be positioned for subsequent processing; for example, cold reduction or annealing. Such continuous strip casting systems have found their primary usage to data in aluminum and aluminum alloy strip production; however, strip production of other metals and metal alloys may also be accomplished through the use of continuous strip casting systems.

Because the hot strip mill stands are directly in line with a caster and make use of the heat from the casting in achieving the strip reduction, a coolant must be provided to cool down the mill rolls and to maintain thermal stability. Furthermore, just as in all reduction operations, a lubricant must be provided to the strip surfaces prior to entry into the mill stand. Preferably such lubricant is applied to the strip surfaces directly and is hereinafter referred to as Direct Application Lubricant or DAL.

Recognizing the cooling and lubricant requirements for hot strip mill stands, various arrangements have been attempted in the prior art for providing the requisite coolant and DAL. One of these arrangements was to permit coolant to cascade upon the strip is hot rolling operations. Lubrication was achieved by making the coolant soluble oil and water. However, this combined coolant-lubrication arrangement has proved unsatisfactory in a number of applications; for example, in instances of slow operations, the application of a coolant to the strip may be deleterious to the system operation for the temperature of the strip may be reduced below that necessary or desirable for the hot reduction at the rolling mill stands. Furthermore, in a continuous casting operation metallurgical problems may result if coolant makes contact with the strip being rolled. This coolant contact may result in a disturbance of the strip oxide coating (the coating having developed because the higher speed of solidification of the cast strip causes a greater supersaturation of the strip surfaces with foreign atoms) and a resultant unacceptable appearance or other metallurgical problems which would necessitate limited uses for the strip or a subsequent annealing step.

To eliminate the above-mentioned problems or, in the least, greatly alleviate them, the invention herein includes a hot strip rolling mill stand which independently applies coolant and DAL and includes means for collecting the coolant independently of the DAL and preventing the coolant from coming into contact with the strip. Thus, the oxide coating is not disturbed and the reduced strip presents a more uniform surface and more consistent metallurgical qualities than strip which was reduced by many prior art continuous strip casting systems.

In order to achieve the above purpose, the invention herein includes sealing means for preventing the coolant from coming into contact with the strip and thereafter channelling such coolant into a suitable containment area. This sealing means is particularly critical adjacent the application of the coolant to the upper roll. At this location the principal coolant system sealing means must be readily interchangeable and adjustable to compensate for seal and roll wear. In this regard the primary coolant sealing means of this invention is structured and carried by the strip rolling mill stand to be removable directly with the rolls during roll changing. Thus the seal may be readily changed or calibrated simultaneously with roll change without the requirement for additional time of any substance other than the time normally required to change rolls. In this regard, it is noted that it is often required to change rolls at least once a day. The time for roll and seal replacement or adjustment by using the principles of the present invention may be accomplished in a relatively brief period; for example, 4 or 5 minutes. However, if the seal were to be carried by the mill stand, the seal changing time alone might be 15 minutes or more. Thus, the mill down time is substantially reduced with the present invention.

A still further feature of the present invention resides in the manner in which the DAL is applied. In many prior systems, the DAL was sprayed or permitted to cascade directly onto the strip prior to reduction or otherwise applied, for example with a rotating member, which may have resulted in uneven distribution of the applied DAL. Spraying, cascading or uneven DAL distribution may decrease the efficiency of the mill reduction and also raises the potential of fire hazard, particularly at initial contact of the DAL with a high temperature strip as the strip enters the first hot strip reduction mill. To alleviate these problems, the invention herein includes means to provide an air spray after DAL wiping application to control the thickness or uniformity of the DAL oil film.

The invention herein includes still additional advantages over the prior art which will become readily apparent after reading the hereinafter set forth description, for example: the utilization of baffle or labyrinth type seals for the DAL containment systems wherever practical; and the services of air, DAL, coolant, electrical power and the like are attached to sections of the system which remain with the mill stand during roll changing and thus, no service connections or disconnections need be made when changing the rolls.

Accordingly, it is one primary object of this invention to provide a hot strip rolling mill stand for use in the hot rolling process of a continuous strip system which includes separate DAL and coolant containment systems and with means to prevent the coolant from contacting the strip.

Another object of this invention is to include a coolant system wherein the primary containment sealing means are removable with the rolls during roll changing and are readily interchangeable and adjustable.

A still further object of this invention is in providing a system which includes means for a relatively uniform application of the DAL to the system components thus increasing the system efficiency and reducing the potential of fire hazards.

Yet further objects of this invention are to provide improved containment sealing means and also to include structural arrangements wherein service connections and disconnections are eliminated or greatly alleviated during roll changing.

These and other objects and advantages of the present invention will become more readily apparent upon a reading of the following description and drawings in which.

Figure 3:
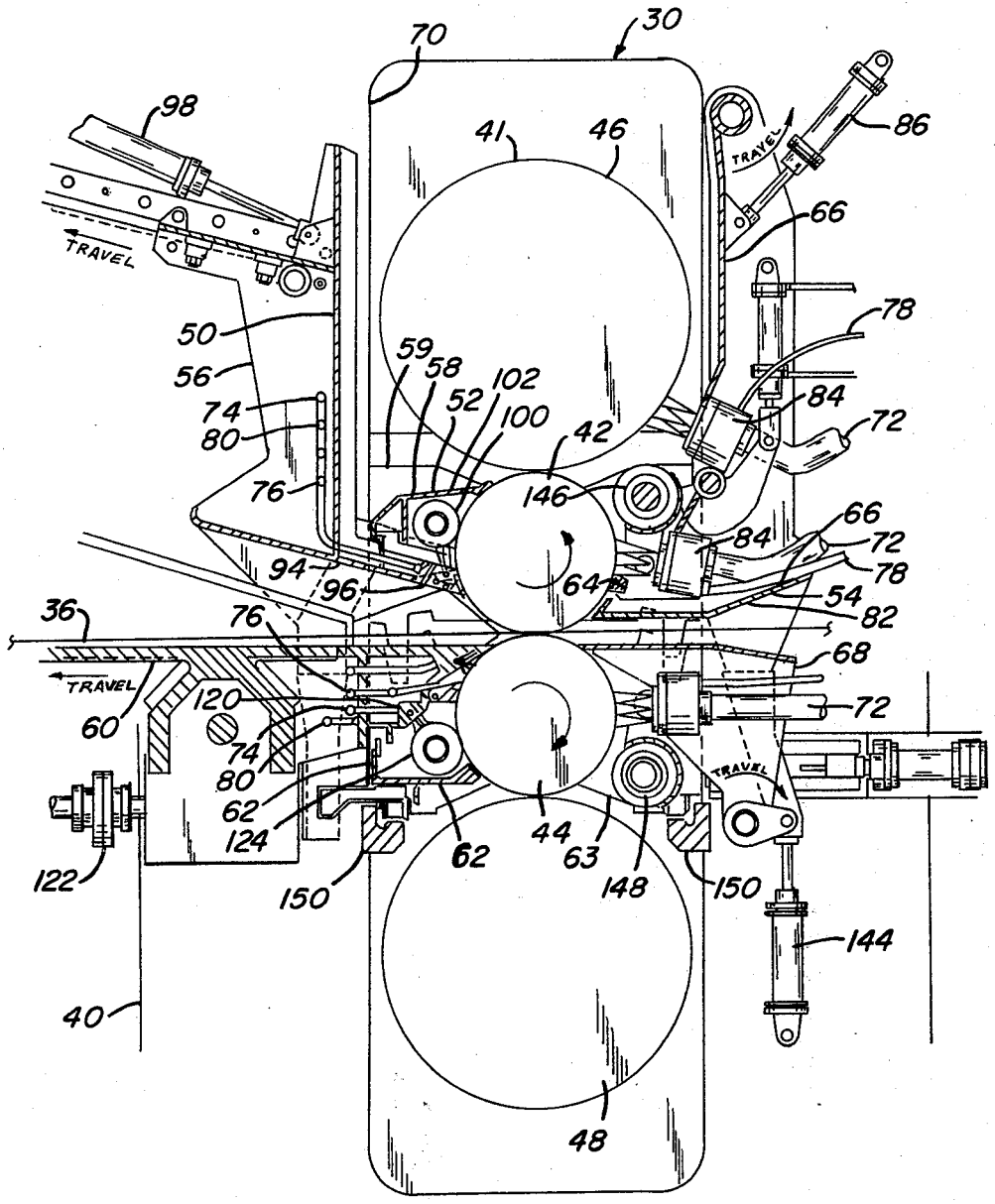
FIG. 3 is an enlarged schematic side elevational view of a hot strip rolling mill stand constructed in accordance with the principles of the present invention and of the type illustrated in FIGS. 1 and 2.
Figure 8:
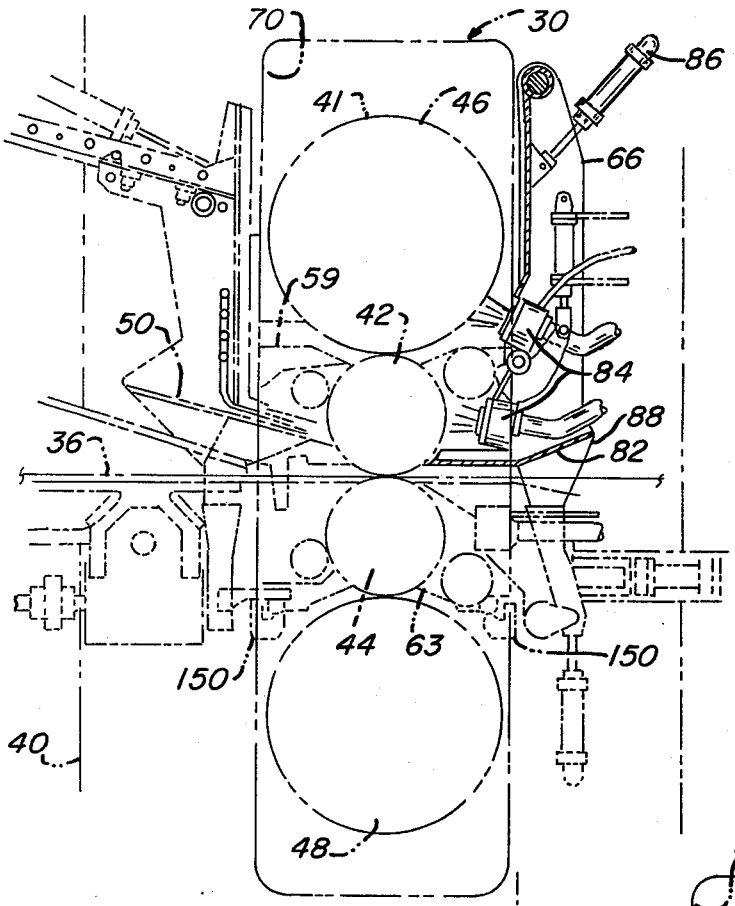
Figure 7:
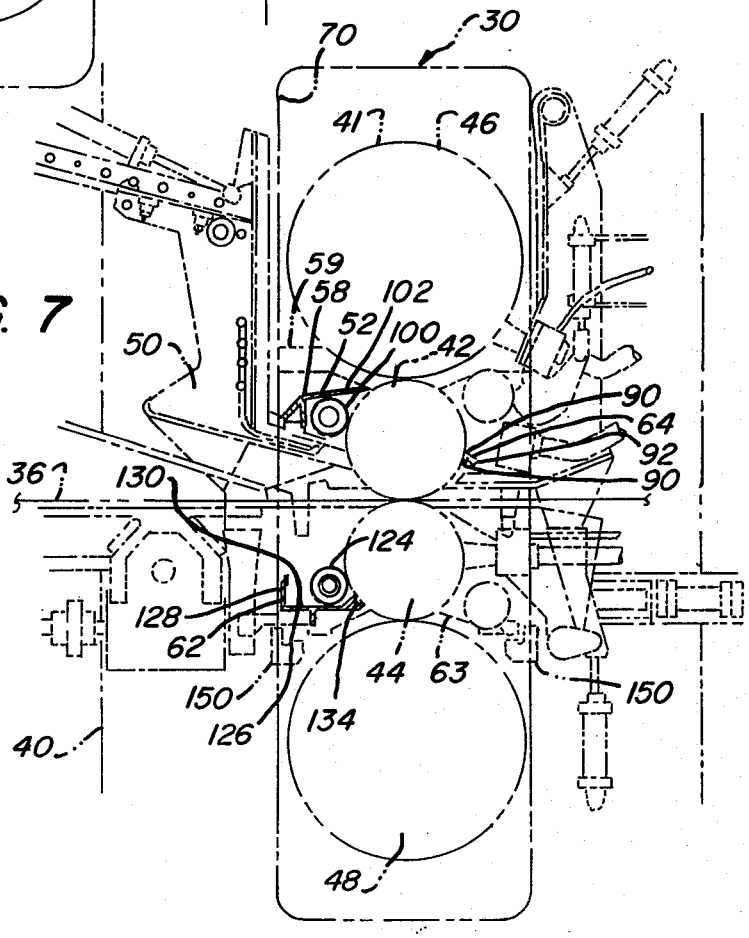

FIG. 7 is a schematic side elevational view of the hot strip mill stand of FIG. 3 which more definitively illustrates assemblies which are carried by the roll chocks and which are withdrawn from the mill stand with the chocks during roll changing. Specifically, these chock-carried assemblies include the coolant wiper-DAL lube for the entry side of the top work roll, the coolant wiper-DAL seal for the entry side of the bottom work roll, and the coolant wiper-deflector for the delivery side of the top work roll; and FIG. 8 is a schematic side elevational view of the hot strip mill stand of FIG. 3 which more definitively illustrates the coolant catch basin for the delivery side of the top work roll.

Figure 1:
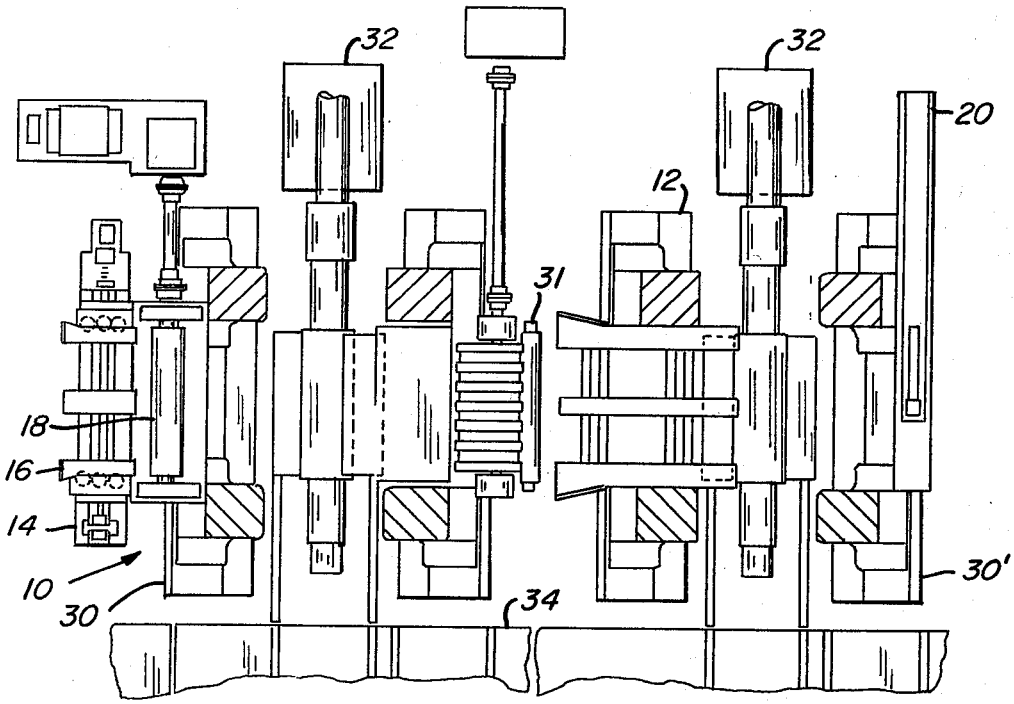
FIG. 1 is a schematic plan view of a portion of a continuous strip casting system which includes a two stand hot strip mill constructed in accordance with the principles of the present invention.
Figure 2:
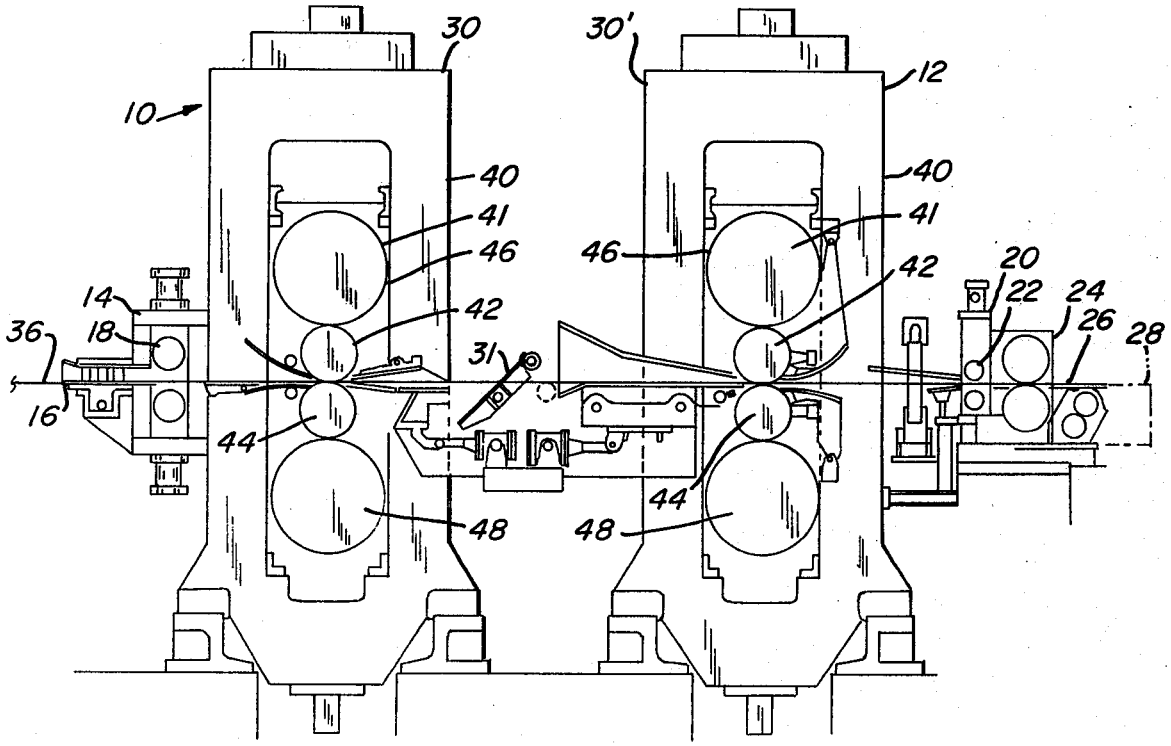
FIG. 2 is a side elevational view of the two stand hot strip mill illustrated in FIG. 1.

Referring to FIGS. 1 and 2 there is illustrated therein a portion of a continuous strip casting system, generally indicated at 10, which comprises a two-stand hot strip mill 12 which continuously receives continuously cast strip from a caster (not shown) through usual mill entry equipment 14 (i.e. side guides 16 and controls 18), and after reduction thereby continuously passing such reduced strip through usual delivery side equipment 20 (i.e. controls 22, carry-over roller and apron set 24, carry-over table 26 and the like). The reduced strip continuously passes from the delivery side equipment 20 for subsequent downstream processing or handling, for example through parting shear and scrap disposal equipment 28 and therefrom to coiler equipment (not shown).

The two-stand hot strip mill 12 comprises: upstream and downstream hot strip reduction mills 30 and 30', respectively, which are constructed in accordance with the principles of the present invention; and interstand equipment 31 which is positioned intermediate the reduction mills 30 and 30'. Each reduction mill 30 and 30' is driven in the usual manner by suitable mill drives 32. On the side of the process line opposite the drive side, suitable roll changing equipment 34 is provided. It is to be noted that the reduction mills 30 and 30' are essentially identical in construction with the primary distinction therebetween being that of left and right hand orientations and other external structural alterations relating to their specific orientation in the processing line and their interrelationship with adjacent equipment. Accordingly, description insofar as the invention herein will be generally set forth with respect to reduction mill 30 with the understanding that a similar description is generally applicable to reduction mill 30'.

The invention herein is generally related to the hot strip rolling mill stand 30 and the other elements specified hereinabove and schematically illustrated in FIGS. 1 and 2 are generally well known in the art. Accordingly, further description of such other elements is not necessary for a full understanding of the invention herein and will not be set forth hereinafter except where necessary to fully describe mill stand 30. It is to be additionally noted that the embodiment of mill stand 30 and the continuous strip casting system 10 as illustrated is generally designed for usage in aluminum and aluminum alloys strip production; however, it is to be understood that mill stand 30 of this invention, as well as individual features thereof, is equally applicable in the strip production of other metal and metal alloys.

Mill stand 30 comprises: a housing 40; a roll assembly 41 consisting or work rolls 42 and 44 and backup rolls 46 and 48 which are suitably received within housing 40 to affect the reduction of strip 36 passing therebetween; and a coolant and direct application lubrication system of the present invention which is generally indicated at 50 and is operable in a manner described hereinafter for the discrete application of coolant for cooling roll assembly 41 and maintaining thermostability and also for applying direct application lubricant (DAL) for the strip 36 being reduced.

System 50 is structured in a manner which provides separate DAL and coolant containment sub-systems, 52 and 54, respectively, which includes an arrangement for preventing the coolant from contacting the strip 36 as well as isolating the coolant from the DAL to prevent contamination of the coolant with DAL. To achieve this mode of operation as well as other distinctive features of this invention as will be described hereinafter, the system 50 may generally be viewed as an assembly of seven independent sections, namely:

A. The section 56 which includes the coolant containment/DAL containment basin for the entry side of the top work roll 42 and which is best illustrated and outlined in FIG. 4 and is carried by the housing 40;

B. The section 58 which includes the coolant wiper-DAL lube for the entry side of the top work roll 42 and which is best illustrated and outlined in FIG. 7 and is carried by the top work roll chocks 59;

C. The section 60 which includes the coolant containment/DAL containment basins for the entry side of the bottom work roll 44 and which is best illustrated and outlined in FIG. 5 and is carried by the housing 40;

D. The section 62 which includes the coolant wiper/-DAL seal for the entry side of the bottom work roll 44 and which is best illustrated and outlined in FIG. 7 and is carried by the bottom work roll chocks 63;

E. The section 64 which includes the coolant wiper-deflector for the delivery side of the top work roll 42 and which is best illustrated and outlined in FIG. 7 and is carried by the top work roll chocks 59;

F. The section 66 which includes the coolant catch basin for the delivery side of the top work roll 42 and which is best illustrated and outlined in FIG. 8 and is carried by the housing 40; and G. The section 68 which includes the coolant deflector-stripper for the delivery side of the bottom work roll 44 and which is best illustrated and outlined in FIG. 6 and is carried by the housing 40.

As will be described in detail hereinafter, Sections 58, 62 and 64 are carried by respective work roll chocks and will be removable from the reduction mill 30 with the roll assembly 41 during changing thereof. On the other hand, Sections 56, 60, 66 and 68 are carried by the housing 40 and will pivot or translate away from the roll assembly 41 to clear the housing window 70 during roll changing. Such an arrangement is extremely advantageous in that it permits roll changing and seal adjustment to be efficiently carried out with a minimum of production down time. The efficiency of roll changing is further provided for by this invention in that the various entry connections for coolant, DAL, air and electrical service, which are respectively schematically indicated at 72, 74, 76 and 78, as well as the DAL return service connection 80, are all made at the pivotal or translating sections 56, 60, 66, and 68. Thus, during roll changing no service connections or disconnections need be made at the reduction mill 30.

Referring now to FIGS. 3 and 8 there is illustrated Section 66 of system 50 which comprises: the coolant catch basin portion 82 for the delivery side of the top work roll 42; coolant spray headers 84 upwardly adjacent portion 82; and suitable pivot means 86 for selectively pivoting the section 66 away from the window 70 during roll changing operations. Section 64 is carried by the top work roll chocks 59 vertically intermediate the catch basin portion 82 and the spray headers 84 and is operative to act as a wiper-deflector to direct the coolant to basin portion 82 and to prevent coolant from passing thereby thus contaminating the surface of the strip 36 being reduced. The coolant directed to basin portion 82 flows therefrom through a suitable drain 88 thence to a sump (not shown).

The coolant wiper-deflector section 64 comprises a pair of wiper seals 90 which include a vent 92 therebetween. The wiper seals 90 are in contact with the adjacent periphery of the upper working roll 42. The vent 92 provides a mean for lubrication of the wiper seal tips as well as an arrangement to better insure that coolant does not pass the section 64. It is to be noted that the wiper seal arrangement of section 64 is withdrawn from the chocks 59 during roll changing and thus is adjustable externally from the mill housing 40.

Figure 4:
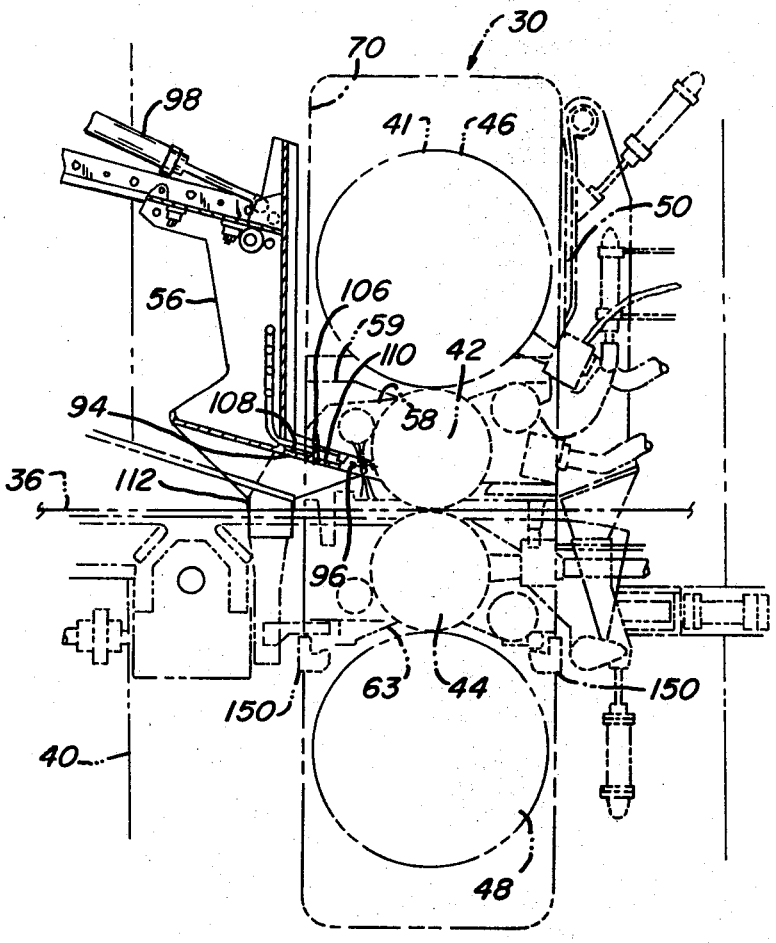
FIG. 4 is a schematic side elevational view of the hot strip mill stand of FIG. 3 which more definitively outlines the coolant containment and DAL containment basin for the entry side of the top work roll.

As is best illustrated in FIGS. 3 and 4, section 56 of system 50 comprises: a combination coolant and containment basin portion 94 for the entry side of the top work roll 42 which includes an integral header means 96 for DAL spray and return, fire prevention and air; and a translating means 98 for selectively moving the section 56 away from the window 70 during a roll changing operation. Section 58 is carried by the top work roll chocks 59 upwardly adjacent an inner end portion of basin portion 94 and comprises: an applicator roll 100, such as of felt or the like, in rotatable contact with an adjacent peripheral portion of the top work roll 42; and a deflector and sealing portion 102.

Section 58 is cooperable with section 56 in a manner that the DAL is sprayed from header 96 to saturate applicator roll 100. Applicator roll 100 smooths the saturated DAL onto the adjacent work roll 42. The inner end of the basin portion 94 is shaped as a converging wedge section and, in conjunction with an inwardly directed air spray from the header means 96, acts to smooth and control the oil film thickness as the work roll 42 rotates thereby. This smoothing and thickness control also prevents oil film from dripping directly onto the strip 36 thus alleviating the potential of a fire hazard or damage to the surface of strip 36. The header means 96 is also structured to provide a fire protection spray which is oriented to spray directly onto the upper surface of the downwardly spaced strip 36.

The upper wall of the deflector and sealing portion 102 prevents splashing of the DAL and possible contamination of the coolant therewith. The portion 102 additionally includes a downwardly extending baffle 104 which cooperates with an adjacent upwardly extending baffle 106 of the basin portion 94 to form a labyrinth seal to define discrete coolant and DAL basin areas 108 and 110, respectively, in basin portion 94. Thus coolant channeled to basin area 108 is drained therefrom through a suitable drain 112 and DAL collected within basin area 110 is drained therefrom via the DAL return. The coolant collected within basin area 108 is a carryover from the application at coolant spray headers 84 and is directed to area 108 and prevented from contaminating the DAL by means of a wiper sealing means 114 which is carried by section 58 at the innermost end of the upper wall of the deflector and sealing portion 102. Wiper sealing means 114 is of the general configuration of the sealing portion of section 64 as described hereinabove and is oriented to direct coolant upwardly and outwardly therefrom to the coolant basin area 108.

Figure 5:
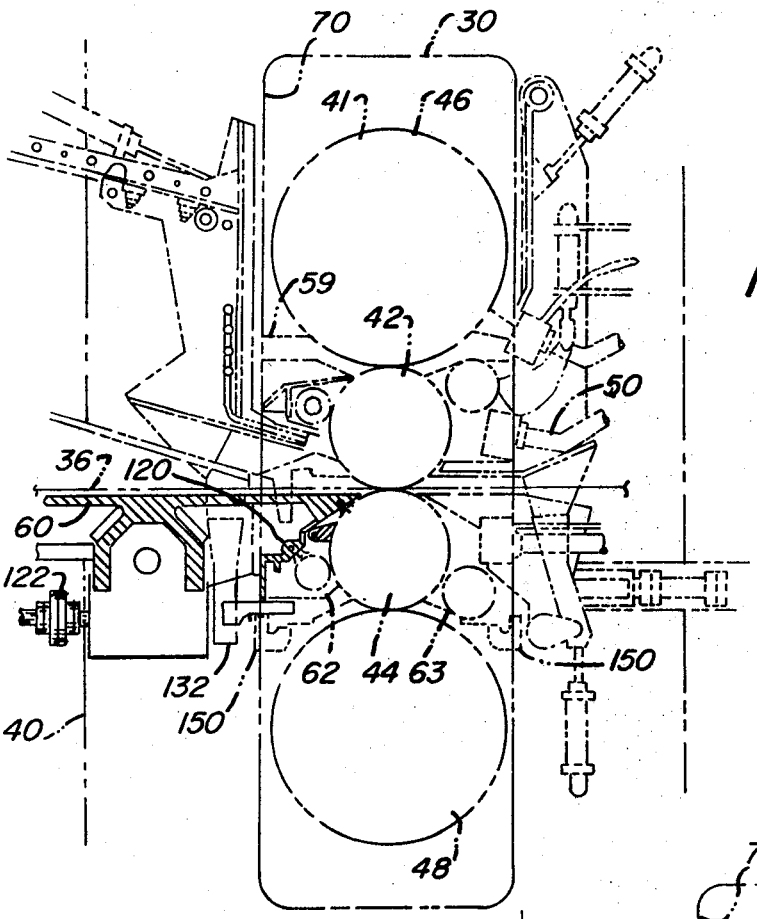
FIG. 5 is a schematic side elevational view of the hot strip mill stand of FIG. 3 which more definitively outlines the coolant containment and DAL containment basin for the entry side of the bottom work roll.

Referring now to FIGS. 3, 5 and 7, section 60 of system 50 comprises: an integral header means 120 at the entry side of the work roll 44 for DAL spray and return, fire prevention and air; and a translating means 122 for selectively moving the section 60 away from the window 70 during roll changing operations. Section 62 is carried by the bottom work roll chocks 63 downwardly adjacent the header means 120, is similar in construction to section 58 described hereinabove, above, and comprises: an applicator roll 124 in rotatable contact with an adjacent peripheral surface of the bottom work roll 44; and a containment and sealing portion 126. Section 62 is cooperable with section 60 in a manner that the DAL is sprayed from header means 120 to saturate the application roll 124. Application roll 124 smooths the saturated DAL onto the adjacent work roll 44. The inner end of the header means 120 is shaped as a converging wedge section and, in conjunction with an inwardly directed air spray, acts to smooth and control the oil film thickness as the bottom work roll 44 rotates thereby. The header means 120 is also structured to provide a fire protection spray which is oriented to spray directly onto the lower surface of the upwardly spaced strip 36.

The surface of section 60 upwardly adjacent the application roll 124 prevents splashing of the DAL on the lower surface of the strip 36. The containment and sealing portion 126 additionally includes an upwardly extending baffle 128 which cooperates with a transversely adjacent walled portion of section 60 to form a labyrinth seal to define a DAL basin area 130 in containment and sealing portion 126. Thus DAL collected within basin area 130 is drained therefrom via the DAL return. Section 60 additionally carries a suitable drain 132 which is in communication with the drain 112 for the draining of coolant from the coolant basin area 108 of section 56.

The containment and sealing portion 126 additionally carries a wiper sealing means 134 adjacent the innermost end thereof. Wiper sealing means 134 is of a general configuration of the wiper sealing means 114 discussed hereinabove and is oriented to prevent coolant which is applied at section 68 from contaminating the DAL applied at sections 60 and 62.

Figure 6:
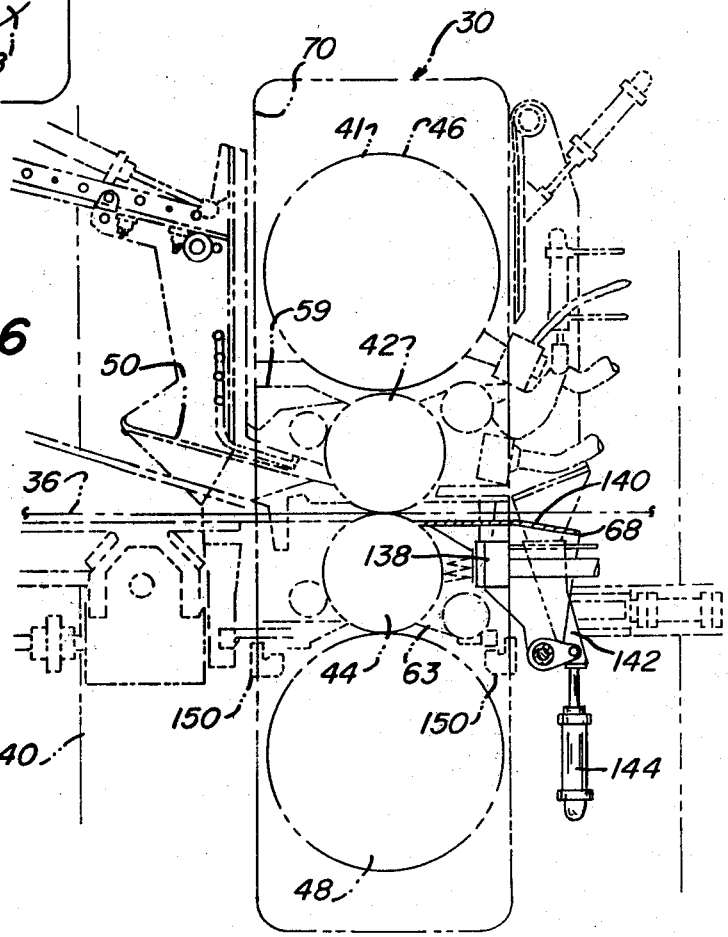
FIG. 6 is a schematic side elevational view of the hot strip mill stand of FIG. 3 which more definitively outlines the coolant deflector-stripper for the delivery side of the bottom work roll.

Referring to FIGS. 3 and 6 there is illustrated the section 68 which comprises: coolant sprayheaders 138; a deflector portion 140 upwardly adjacent sprayheaders 138 to prevent coolant sprayed therefrom from contacting the underside of strip 36; a coolant drain 142 which is in communication with drain 88 for the draining of collected coolant from basin portion 82 of section 66; and pivoting means 148 for the selective pivoting of section 68 away from the window 70 during roll changing.

In addition to the above described sections of the coolant and direct application lubricator system 50, the system 50 additionally includes top and bottom scratch brush assemblies 146 and 148, respectively. Assemblies 146 and 148 are respectively carried by the top and bottom work roll chocks 59 and 63 at the delivery side of the roll assembly 41 at least closely adjacent the roll peripheral surfaces thereof.

With the sectional arrangement of system 50 as described hereinabove roll changing and/or wiper seal replacement is efficiently accomplished by a series of rapid steps, including:

1. Pivoting or translating sections 56, 60, 66 and 68 a distance to clear the housing window 70;

2. The work rolls 42 and 48, which are keyed together in the usual manner, are lowered down into the fixed rails 150 which span the housing 40;

3. The work rolls 42 and 48, together with sections 58, 62 and 64 and scratch brushes 146 and 148 are pulled or pushed from the mill 30;

4. New work rolls 42 and 48 with other sections 58, 62 and 64 and scratch brushes 146 and 148 are pulled or pushed into position in the mill 30; and 5. The sections 56, 60, 66 and 68 are pivoted or translated back into operating position.

It is to be noted that in none of the steps indicated above is there ever a necessity to remove or disconnect any service connections for air, DAL, coolant or electrical. The service connections are all carried by the movable sections 56, 60, 66 and 68.

The embodiment described hereinabove is the preferred embodiment of a system 10 which includes therein elements of the present invention and it is to be understood that various modifications can be made thereto without departing from the scope of this invention which is only defined by the claims set forth hereinafter. For example: certain of the sections 56, 58, 60, 62, 66 and 68, or elements thereof, may be utilized in a reduction mill without he necessity of other sections to provide uniqueness of invention (i.e. the utilization of an airspray to smooth and control the oil film thickness subsequent to DAL being applied to the work rolls 42 or 44); the translating and pivoting arrangements for sections 56, 60, and 68 may be readily altered from the arrangements illustrated in the drawings; and the spray headers may be reoriented somewhat from the specific locations shown; and the like.

What is claimed is:

1. In a rolling mill wherein at least upper and lower mill rolls are rotatably mounted in window means of a mill housing to reduce strip passed therebetween and wherein a direct application lubricant is applied to said mill roll on the entry side of such a rolling mill, the improvement comprising: applying means to continuously apply such direct application lubricant to adjacent peripheral portions of said mill rolls prior to said adjacent peripheral portions engaging such strip for the reduction thereof; and smoothing means spaced from said applying means, of at least said upper mill roll, in the direction of rotation of said upper mill roll and operable to direct a flow of air to said upper mill roll to smooth and control the thickness of such direct application lubricant applied by said applying means to respective adjacent peripheral portions of said at least said upper mill roll prior to said respective adjacent peripheral portions engaging such strip for the reduction thereof.

2. In a rolling mill as specified in claim 1 including applying means and smoothing means for each of said mill rolls.

3. In a rolling mill as specified in claim 2 wherein each of said applying means comprises a rotatably mounted member in rolling engagement with a respective adjacent peripheral portion of said mill rolls and additionally including spray means to spray such direct application lubricant onto said members for subsequent application to said mill rolls.

4. In a rolling mill having entry and delivery sides for strip passing therethrough and wherein at least upper and lower rolls are rotatably mounted on respective upper and lower bearing chocks in window means of a housing to reduce such strip passed therebetween, said bearing chocks and mill rolls being removable, as a unit, from said window means for roll changing and wherein coolant is applied to said mill rolls on the delivery side of such a rolling mill for cooling said mill rolls, the improvement comprising: coolant applying means to apply such coolant to said mill rolls; coolant draining and sealing means operable to drain and to seal such coolant into a confined area to prevent any substantial portion of such coolant from contacting such strip; said draining and sealing means including a first coolant sealing assembly in wiping engagement with said upper mill roll adjacent the delivery side thereof at a location spaced, in a direction opposite the direction of rotation of said upper mill roll, from the portion of said applying means which applies coolant to said upper mill roll; and said first sealing assembly being carried by said upper bearing chock and being removable, as a unit, with said chocks and said mill rolls during roll changing.

5. In a rolling mill as specified in claim 4 wherein said first sealing assembly includes a pair of arcuately spaced seals in wiping engagement with said upper mill roll and a hydraulic relief channel intermediate said pair of seals and extending in a generally radial direction with respect to said upper mill roll.

6. In a rolling mill as specified in claim 4 wherein said draining and sealing means includes a second coolant sealing assembly in wiping engagement with said lower mill roll adjacent the entry side thereof at a location spaced, in the direction of rotation of said lower mill roll, from the portion of said applying means which applies coolant to said lower mill roll; and said second sealing assembly being carried by said lower bearing chocks and being removable as a unit with said chocks, said mill rolls and said first sealing assembly during roll changing.

7. In a rolling mill as specified in claim 6 wherein said draining and sealing means includes a third coolant sealing assembly in wiping engagement with said upper mill adjacent the entry side thereof at a location spaced, in the direction of rotation of said upper mill roll, from the portion of said applying means which applies coolant to said upper mill roll; and said third sealing assembly being carried by said upper bearing chocks and being removable as a unit with said chocks, said mill rolls, and said first and second sealing assembly during roll changing.

8. In a rolling mill as specified in claim 7 additionally comprising: direct application lubricant applying means, adjacent the entry side of such a roll mill, to apply direct application lubricant to said mill rolls; and direct application lubricant draining and sealing means which are operable to drain and seal any excess direct application lubricant to prevent the commingling thereof with such coolant.

9. In a rolling mill as specified in claim 8 wherein said direct application lubricant applying means and said direct application lubricant draining and sealing means are movably carried by said housing in a manner that they are selectively pivotal or translatable to clear said window means during roll changing.

10. In a rolling mill as specified in claim 9 wherein all entry service connections for coolant, direct application lubricant, power and air for all of said applying means and draining and sealing means are carried by said direct application lubricant applying means and draining and sealing means.

11. In a rolling mill as specified in claim 9 wherein portions of said direct application lubricant draining and sealing means cooperate with adjacent portions of said coolant draining and sealing means to form labyrinth seals therebetween to prevent such commingling.

12. In a rolling mill wherein at least upper and lower rolls are rotatably mounted on respective upper and lower bearing chocks in a window of a housing to reduce strip therebetween and said bearing and mill rolls are removable, as a unit, from said window during roll changing, the improvement comprising: first applying means to apply coolant to said mill rolls to cool said rolls; second applying means to apply direct application lubricant to upper and lower surfaces of such a strip; separating means operable to prevent the commingling of such direct application lubricant and such coolant; first portions of said separating means being carried by said chocks and being removable with said chocks and said rolls during roll changing; and all other portions of said separating means being movably carried by said housing for the selective translation or pivoting thereof to clear said window during said roll changing.

13. In a rolling mill as specified in claim 12 additionally including sealing means in wiping contact with said upper and lower rolls and operable to prevent such coolant from contacting the upper and lower surfaces of such strip.

14. In a rolling mill as specified in claim 13 wherein said sealing means are carried by said chocks and are removable with said first portions, said chocks and said mill rolls, as a unit, during roll changing.

15. In a rolling mill as specified in claim 14 wherein all entry service connections for coolant, direct applicant lubricant, power and air for all of said means are carried by said all other portions.

* * * * *